US006051065A

United States Patent [19]

Wakefield et al.

[11] Patent Number: 6,051,065

[45] Date of Patent: Apr. 18, 2000

[54] COATING HOPPER HAVING A REPLACEABLE HOPPER LIP ELEMENT

[75] Inventors: David A. Wakefield, Canandaigua; Daniel J. Suter, Penfield; Douglas S. Finnicum, Webster, all of N.Y.

[73] Assignee: Eastman Kodak Company, Rochester, N.Y.

[21] Appl. No.: 09/150,415

[22] Filed: Sep. 9, 1998

[51] Int. Cl.[7] ..... B05C 3/02

[52] U.S. Cl. ..... 118/410; 118/325; 118/DIG. 2

[58] Field of Search ..... 118/325, 410, 118/419, DIG. 2, DIG. 4; 425/466; 427/356, 420

[56] References Cited

U.S. PATENT DOCUMENTS 5,639,305 6/1997 Brown et al. ..... 118/410

*Primary Examiner*—Brenda A. Lamb

*Attorney, Agent, or Firm*—Mark G. Bocchetti

[57] ABSTRACT

A hopper bar having a longitudinal channel formed in the portion of the bar which normally would support a coating lip wherein a wall of the channel is a precision cylindrical locating pin, and has a replaceable hopper lip element, formed to fit within the channel, is provided with a precision round bushing for receiving the locating pin such that upon assembly of the element to the hopper there is no offset significant to the coating process between the slide surface of the hopper bar and the slide surface of the lip element. The lip element may be attached to the hopper wall along the remainder of their mutual length by either bolts or magnets to permit independent longitudinal thermal expansion of the hopper bar and lip element.

19 Claims, 6 Drawing Sheets

COATING HOPPER HAVING A REPLACEABLE HOPPER LIP ELEMENT

FIELD OF THE INVENTION

The invention relates to apparatus for coating a liquid composition to a substrate surface to form a coated layer thereupon, more particularly to hopper apparatus having a lip for forming a flowing sheet of substantially uniform thickness of the liquid composition, and most particularly to hopper apparatus wherein a lip element is replaceably attached to a hopper body.

BACKGROUND OF THE INVENTION

In forming a flowing sheet of a liquid composition for coating onto a substrate surface, the composition is reshaped from collimated flow in a pipe to sheet flow typically by an apparatus known variously in the art as a die, a distributor, an extruder, a weir, and a hopper. As used herein, all such types of apparatus are referred to collectively as hoppers. A hopper may comprise one or more parallel longitudinal members which are oriented transverse to the direction of liquid flow, which members may be bolted together or otherwise attached to form a hopper unit. A primary member may be referred to as a "hopper body," and one or more secondary members as "hopper bars. " Within a hopper, a flow path for liquid composition typically includes in flow sequence an inlet, one or more transverse distribution voids known as cavities, and a slotted exit from each cavity communicating with either a successive cavity or the exterior of the hopper. The last such slot is commonly known as an exit slot. Alternatively, a hopper distribution apparatus may include a distribution chamber open at the top and having a wall forming a weir for overflow cascade or curtain coating therefrom.

In an extrusion hopper, the downstream end of the exit slot typically defines a coating lip from which the extruded sheet of composition is transferred directly to the passing substrate to be coated. In extrusion/slide hoppers, as are used typically in the manufacture of photographic films and papers, composition is extruded from the exit slot onto an inclined slide surface terminating at a lower edge in a coating lip. The extruded sheet flows down the slide surface under gravity and is transferred to the passing substrate either through a dynamic longitudinal bead, as in bead coating, or a falling curtain, as in curtain coating.

In all such coating methods, the cross-sectional shape and longitudinal uniformity of the lip itself is of paramount importance. Defects in a lip or departures from design resulting from abuse as well as ordinary wear and tear can cause degraded coating uniformity resulting in inferior product or outright waste. Thus it is highly important that hopper coating lips be maintained in a state of near perfection as regards their designed configuration. However, other practical considerations can make this difficult. For example, hoppers are known to have been made from a variety of hardenable stainless steel alloys, such as AISI 304 and 316. For simple hoppers intended for coating only one or a few different compositions simultaneously, the specific gravity of these alloys is not a consideration; but for large hoppers capable of delivering, for example, five or more compositions, the mass of the hopper can become formidable, leading to an alternative choice of lighter alloys comprising, for example, aluminum or titanium. Such alloys can be softer than stainless steel, making the lips of such hoppers more easily damaged and also more easily worn by wiping during cleaning and preparation for coating. When a lip is damaged or worn beyond some useful limit, the hopper must be removed from service and the hopper bar containing the lip must be remachined to recreate the original lip. This reduces the available runtime of the hopper and can be expensive in remachining and reassembly and calibration of the reassembled hopper. Further, the remachined bar is now smaller than previously, which can lead to known problems in recalibration of the hopper. Further, the bar may be remachined only a few times before it is too small for further machining and must be discarded and replaced.

The nominal cross-sectional geometry of a coating hopper lip is an important factor in coating successfully under a specific set of conditions. As conditions are changed, for example, from bead coating to curtain coating, the lip design must also be changed. In the known art, hoppers are not practically interchangeable through various coating conditions or methods because of the extreme difficulty in exchanging the first hopper bar, which carries the coating lip. Instead, typically separate entire hoppers are fabricated for differing coating conditions requiring different hopper lips, at very large capital cost.

Some of the best materials for hopper lips, such as various of the Stellite series of alloys, are impractical for use in building entire hoppers. Such materials can be machined to a virtually perfect lip, and their extreme hardness makes such lips virtually indestructible in normal use. However, many such materials are unsuited for overall hopper manufacture because of high cost, high density, high brittleness, thermal instability, or difficulty in machining.

U.S. Pat. No. 5,639,305 discloses an extrusion hopper having a replaceable, flexible strip forming the overbite edge of the hopper extrusion slot. The strip is held in place either by vacuum applied to the back side of the strip through porting in the hopper bar or by being clamped between two bars. No means is provided for locating and holding the strip precisely within the exit slot to maintain a uniform height of the exit slot and uniform spacing of the edge strip from the substrate being coated. Further, offset between the slot surface and the strip surface is not controlled. FIG. 16 indicates a significant gap at that juncture, which would be unacceptable for a free-flowing slide surface in an extrusion/slide hopper. Also the loss of vacuum could be detrimental to the coating roll hopper and other hardware.

U.S. patent application, Ser. No. 08/826,539, filed Apr. 3, 1997, discloses a metal hopper having a replaceable hopper lip formed from ceramic. The hopper bar and lip element differ substantially in thermal expansion coefficient, and the lip element is shrink fitted to the hopper bar by cooling the ceramic from room temperature to between 0° C. and −196° C., sliding the ceramic lip element over the metal, and allowing the overlap of lip element and bar to compress as the lip element is returned to room temperature. Thus emplaced, the lip element is not readily slidable on the metal bar to relieve thermal stresses, and the system can maintain hopper straightness over a working temperature range only through high elastic modulus of the ceramic.

Thus there is a need for a method and apparatus to allow the replaceable disposition of a specially-formed hopper lip element on a hopper configured to receive such clement wherein the lip element is precisely positioned in a vertical and one horizontal direction while being allowed to slide along the hopper in another horizontal direction to relieve thermal stresses between the hopper and the lip element, thus preventing thermal distortion of the hopper.

SUMMARY OF THE INVENTION

It is a principal object of the invention to provide an improved hopper and replaceable hopper lip element wherein the hopper lip element may be readily removed from the hopper and replaced with another hopper lip element having the same or different hopper lip design.

It is a further object of the invention to provide an improved hopper and replaceable hopper lip element wherein differences in coefficient of thermal expansion between the hopper and hopper lip element are dynamically prevented from causing thermal distortion of the assembled hopper.

It is a still further object of the invention to provide an improved hopper and replaceable hopper lip element wherein the transition offset between the hopper slide surface and the hopper lip element slide surface is of negligible effect on the coating process.

It is a still further object of the invention to provide an improved hopper and replaceable hopper lip element wherein the range of materials available for forming the hopper lip element is greater than the range of materials of practical use in forming the hopper itself.

The apparatus and method of the present invention are useful in providing uniform coatings of liquid compositions to moving substrates over long periods of use of the apparatus.

Briefly described, the present invention includes a hopper front bar having a highly uniform longitudinal channel formed in the bar in the forward portion of the bar which normally would support a coating lip. The coating lip itself may be from 0.001 to 0.250 of an inch and is located at the tip of the lip element which is preferably 0.25 to 4.0 inches. The forward-facing wall of the channel, preferably orthogonal to the adjacent slide surface, is provided near one end with a precision cylindrical locating pin, formed of a hard, non-galling, corrosion-resistant material, preferably from a Stellite alloy, which extends from the wall. Stellite alloys, comprising cobalt, chromium, and tungsten, are well known for their hardness and dimensional stability. A replaceable hopper lip element having a specialized lip geometry is formed to fit within the channel and is provided with a precision round bushing disposed in the rear wall of the element for receiving the locating pin upon assembly of the element to the hopper, the bushing being located in the element such that after assembly there is no offset significant to the coating process between the slide surface of the hopper bar and the slide surface of the lip element in the vertical direction.

The lip element is attached to the hopper wall along the remainder of their mutual length preferably in one of two different ways, each of which permits independent longitudinal thermal expansion of the hopper bar and lip element, to prevent thermal distortion of the assembled apparatus that might affect the coating process, while simultaneously preventing relative vertical movement between the bar and element slide surfaces anywhere along their length. The lip element is preferably from about 75% to about 99% of the hopper channel and is located at the coating tip of said channel.

In a first preferred embodiment, the channel wall is further provided with a plurality of spaced apart locating pins similar to the first pin, and the lip element is provided with matching bores, each containing a precision bushing, the opening of which has the same vertical degree of precision as the first bushing but which is elongated in the longitudinal direction of the lip element, such that vertical offset between the hopper bar and the lip element is positively constrained while relative longitudinal movement between the bar and element is essentially unconstrained. The lip element is retained on the pins and against the channel wall by a plurality of bolts passing through horizontally-elongated bores in the lip element and screwed into threaded bores in the hopper bar.

In a second preferred embodiment, the hopper bar and the lip element are provided over at least a portion of their mutual length with longitudinal horseshoe magnets which couple to secure the lip element firmly against the channel wall while permitting relative longitudinal motion as needed for thermal relaxation between the hopper bar and the lip element. One or more additional locating pins and elongated bushings may be included as described above for the first embodiment if desired, although in many applications such additional mechanical constraints may not be necessary.

BRIEF DESCRIPTION OF THE DRAWINGS

The foregoing and other objectives, features, and advantages of the invention will be apparent from the following more particular description, including the presently preferred embodiments of the invention, as illustrated in the accompanying drawings in which.

For a better understanding of the present invention, together with other and further objects, advantages and capabilities thereof, reference is made to the following detailed description and appended claims in connection with the preceding drawings and description of some aspects of the invention.

DETAILED DESCRIPTION OF THE INVENTION

Figure 1:
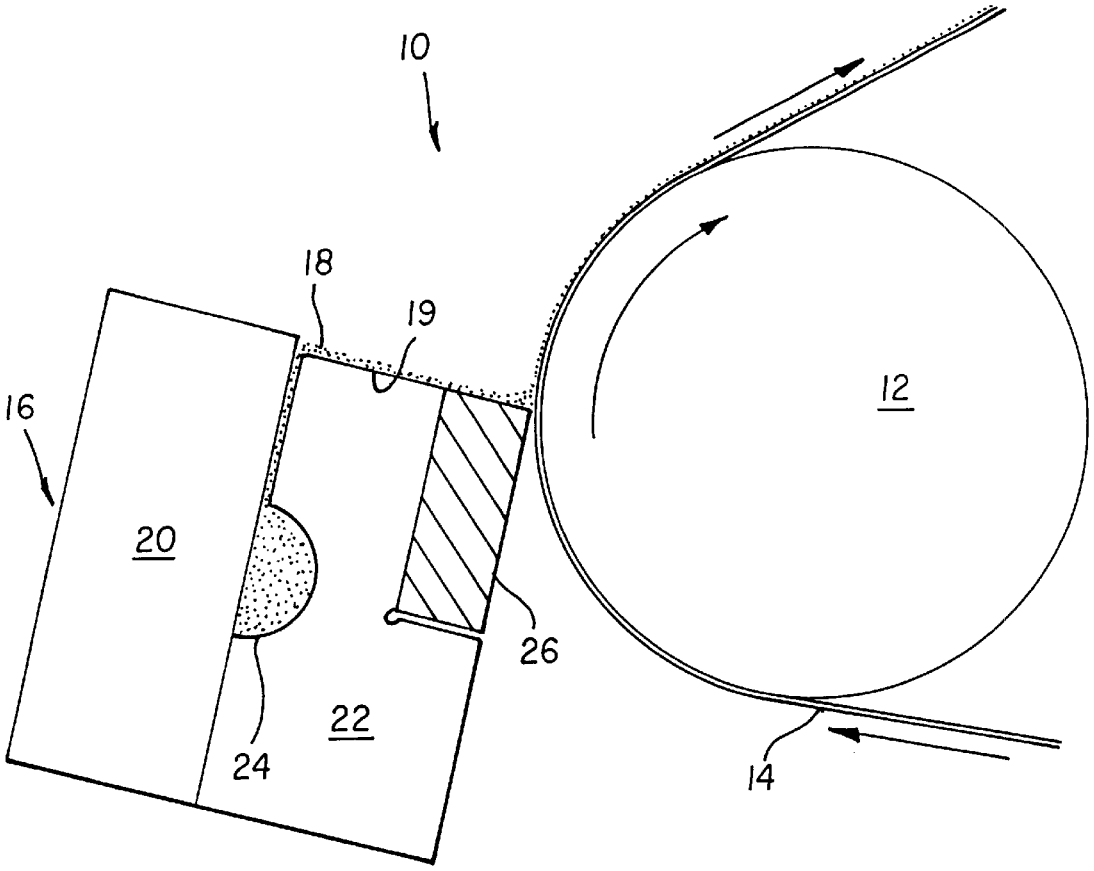
FIG. 1 is a vertical cross-sectional view of a bead coating apparatus in accordance with the invention.

Referring to FIG. 1, a bead coating apparatus 10 includes a coating backing roller 12 conveying as shown by the arrows a moving flexible substrate such as a web 14, and an extrusion/slide hopper 16 for delivering a single layer 18 of a liquid composition along a slide surface 19 to web 14. Hopper 16 comprises a hopper body 20 and a front hopper bar 22 having a distribution cavity 24 and a replaceable hopper lip element 26 in accordance with the invention. Hopper 16 may be formed from any suitable material as is well known in the art, for example, stainless steel, Hastalloy, or titanium/aluminum alloy.

Referring to FIGS. 2 through 5, front hopper bar 22 is formed as by precision machining to have a longitudinal channel, preferably generally rectangular in cross-section, for receiving lip element 26, having a vertical front wall 30 and a bottom 32. Preferably, the channel has an inside grind relief which is used to prevent interferences at internal corner 34.

The hopper and lip elements, of course, may be configured within the scope of the invention as required for other types of coating processes, for example, curtain coating, weir coating extrusion coating. Further, the cross-sectional profile of the lip portion of lip element 26 may be of any shape as required by a particular coating application.

Figure 2:
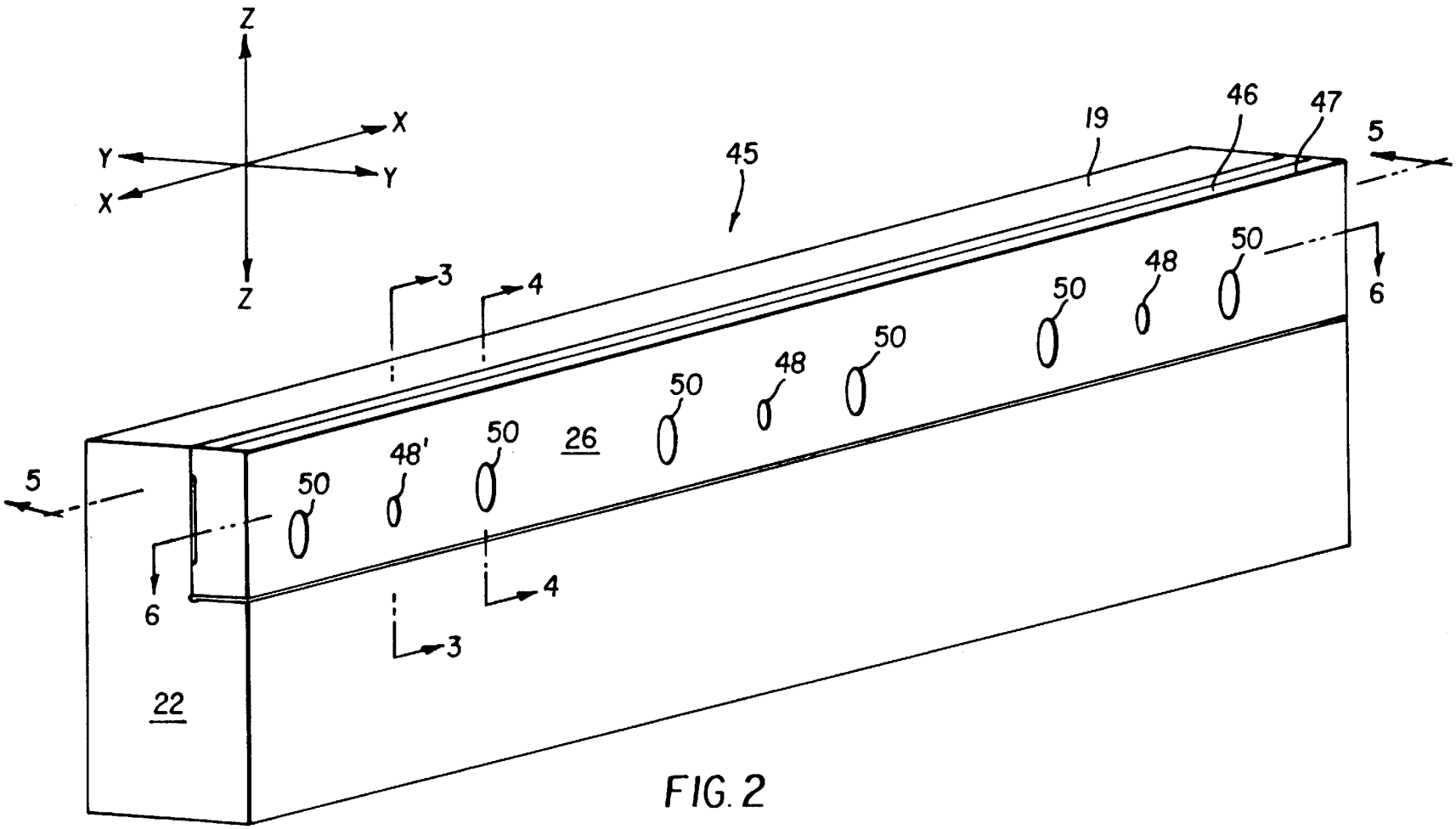
FIG. 2 is an isometric view of a front hopper bar having a hopper lip element in accordance with the first preferred embodiment of the invention.

In this discussion, reference is made to three mutually orthogonal directions, shown in FIG. 2 as X, Y, and Z, respectively. As used herein, the X direction is parallel to the longitudinal direction of the hopper bar and lip element (first horizontal direction); the Y direction is parallel to the hopper slide surface and orthogonal to the longitudinal direction of the hopper bar and lip element (second horizontal direction); and the Z direction is orthogonal to the X and Y directions (vertical direction).

Replaceably attachable within the channel is hopper lip element 26 which preferably is provided with spaced-apart upper and lower longitudinal pads or lands 36,38 for contact with wall 30. Element 26 may be formed of any suitable material, for example, a metal, an alloy, a glass, a plastic, or a ceramic, and preferably a material having low residual stress to minimize warpage during fabrication of element 26. Element 26 is machined to a high degree of precision such that the contact surfaces 40,42 of lands 36,38, respectively, are parallel with the front face 44 of element 26 and are orthogonal to the slide surface 46 of element 26. Slide surface 46 terminates at a forward edge thereof in lip means 47, shown herein for purposes of example as having an included 90° angle. Other cross-sectional shapes of coating lips are well known to those skilled in the art and will readily suggest themselves within the scope of the invention. Different embodiments of element 26 having the same or different lip configurations may be readily exchanged on a given hopper bar within the scope of the invention.

Element 26 may be precision mounted to, and retained upon, face 30 in one of two preferred embodiments, either of which permits ready replacement of a damaged lip element or easy exchange of different lip elements to employ a different lip shape for a successive coating. A further advantage of the invention is that lip elements are exchangeable with high precision among any number of hoppers provided with means for receiving a lip element as described herein.

Figure 4:
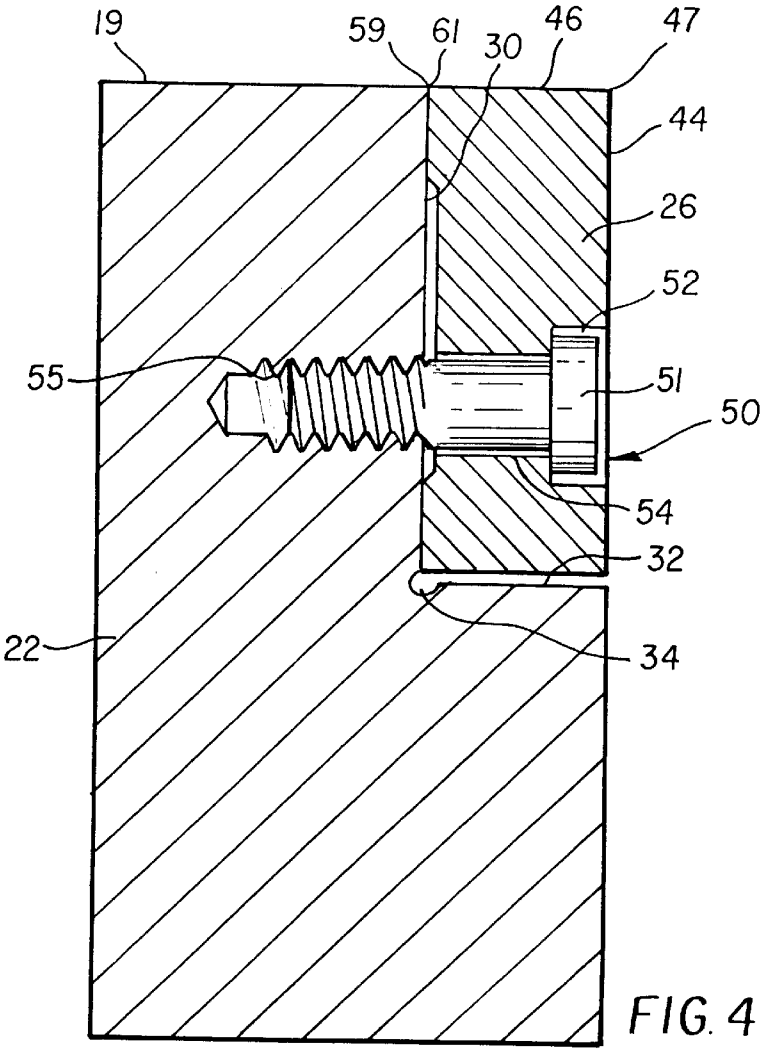
FIG. 4 is a cross-sectional view taken along line 4—4 in FIG. 2, showing a typical bolting assembly for securing the hopper lip element to the hopper bar.

In a first preferred embodiment 45 in FIG. 2, between lands 36 and 38 is a row of bores for receiving either locating bushings or attachment bolts. In face 30 are a plurality of matching locating pins and threaded bores, as described below. One of the bushing bores 48 in lip element 26, preferably the bushing bore nearest one end of the lip element, is a shouldered master bore 48', the other shouldered bushing bores 48 being slaves. Between the bushing bores are bolt bores 50 for receiving attachment bolts 51 in FIG. 4, preferably one on either side of each bushing bore, each bolt bore having a counterbored outer portion 52 for receiving a bolt head and an inner portion 54 for passing a bolt shaft therethrough. Each bolt bore 50 aligns with a corresponding threaded bore 55 in bar 22, as shown in FIG. 4, thus replaceable lip element 26 may be mounted onto bar 22 by such bolts.

Figure 3:
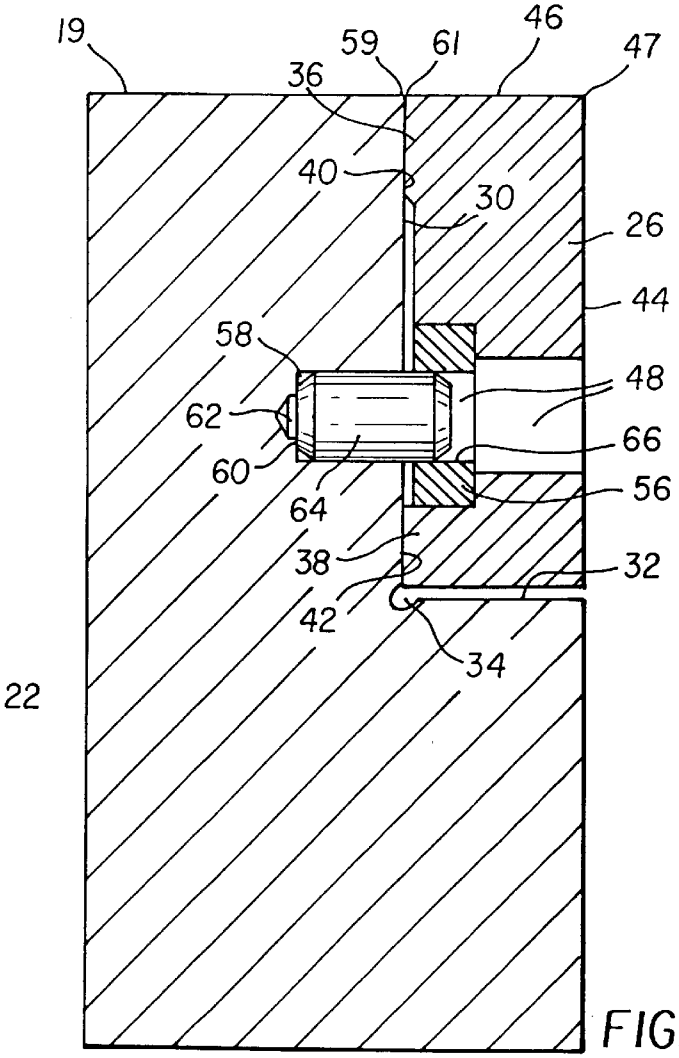
FIG. 3 is a cross-sectional view taken along line 3—3 in FIG. 2, showing the master precision pin in the hopper bar and the master precision bushing in the hopper lip element.

Each bushing bore 48 is precision counterbored as shown in FIG. 3 to accommodate a precision bushing 56 formed of a hard, non-galling, corrosion-resistant, dimensionally-stable material, preferably a Stellite alloy such as Stellite No. 3, which is essentially press fitted into the bushing bore. Opposite each bushing bore 48, in wall 30, is a matching pin bore 58 extending into bar 22 and having a shoulder 60 near a lower extremity 62. Pin bores 58 preferably are evenly spaced along the length of bar 22 and each is jig-ground to a highly precise inside diameter. The center of each bore 58 is exactly the same distance from slide surface 19 as is the center of each bushing bore 48 from slide surface 46, so that when the lip element is assembled to the hopper bar, the slide surfaces will be exactly coplanar with no significant offset therebetween. Preferably, the matching corners 59, 61 of the hopper bar and the lip element are machined to have no significant radius, i.e., less than about 0.001 inches, thus minimizing physical discontinuity between slide surfaces 19 and 46.

Within each bore 58 is a precision-ground pin 64 having a diameter approximately 50 microinches less than the diameter of bore 58. Each pin 64 is sufficiently long that it extends a distance above surface 30 when the pin is fully seated against shoulder 60.

Figure 5:
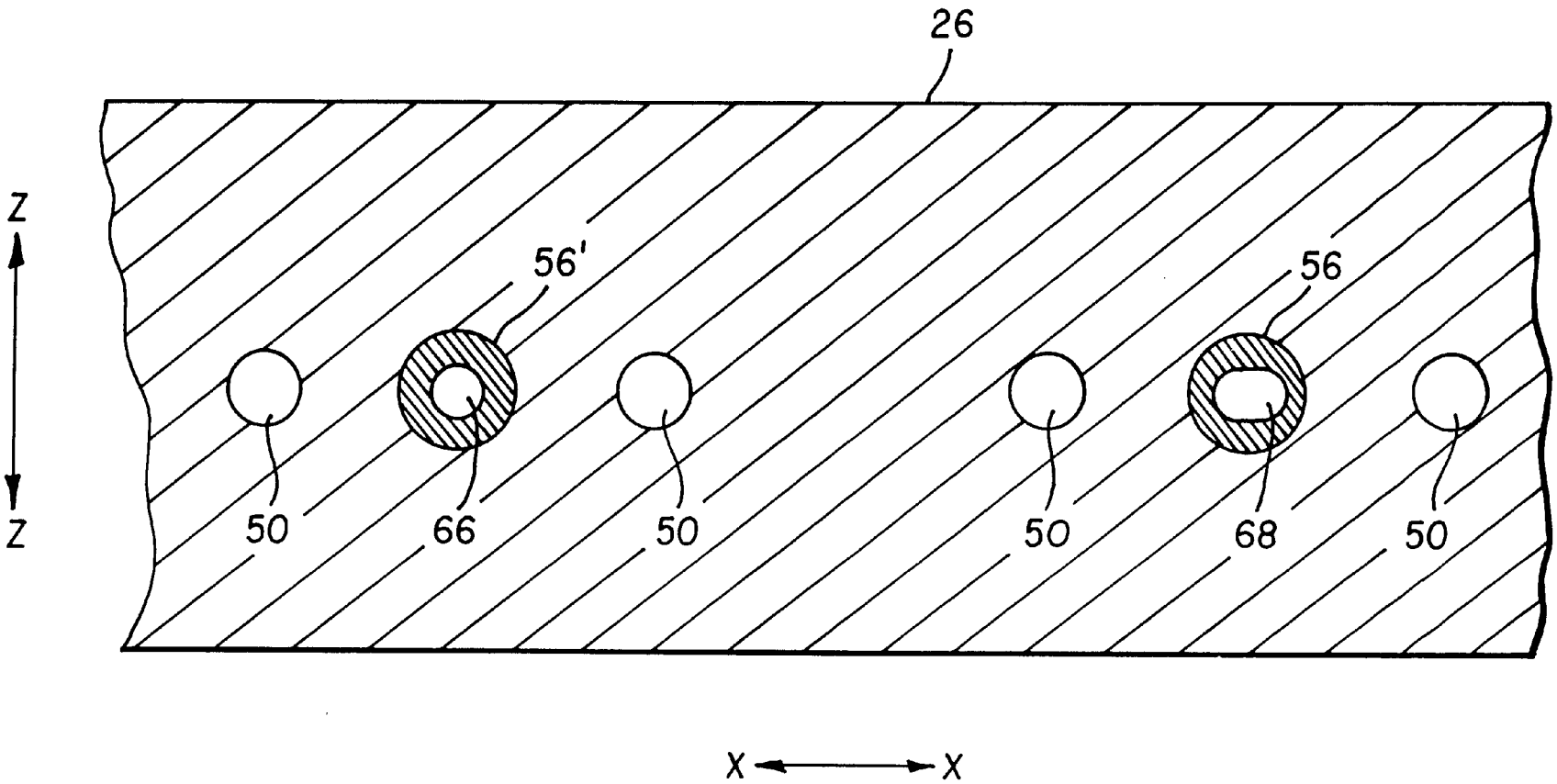
FIG. 5 is a vertical cross-sectional view taken along line 5—5 in FIG. 2, showing a round positioning bore in the master bushing and a slotted positioning bore in a slave bushing.

In master bushing 56', a cylindrical bore 66 is jig-ground at the same diameter as bore 58, such that upon insertion of the protruding portion of pin 64 into master bushing 56' the hopper lip element 26 is properly positioned in the X and Z directions within a tolerance of 50 microinches. Each of the slave bushings 56 is also jig ground to provide a bore 68 having the same Z-direction tolerance as master bushing 56', such that slide surfaces 19 and 46 are coplanar within 50 microinches over their entire mutual length. Each bore 68 is further enlarged in the X direction as shown in FIG. 5 such that upon assembly of the lip element to the hopper bar all locating pins 64 are unconstrained within bores 68 in the X direction. Thus, lip element 26 may be formed of a desirable lip material, such as for example a metal, metal alloy such as Stellite, plastic polymer, glass, or ceramic, which may have a different coefficient of thermal expansion from that of hopper bar 22; and the just-described arrangement permits element 26 and bar 22 to change individual lengths due to thermal expansion or contraction by sliding past each other without engaging each other in the X direction, thus preventing thermal distortion of the hopper unit in the Y direction and thereby maintaining parallelism of lip 47 and substrate 14.

Preferably, pins and bushings are formed as by cutting and grinding from suitable rod stock, or by investment casting, of Stellite No. 3, available from Deloro Stellite Division of Thermadyne Corp., Belleville, Ontario, Canada. Other materials which may be suitable for forming the pins and bushings include hardened and precipitation hardened stainless steels, tool steels, other stellites, ceramics, cemented carbides, and materials having hard plated or coated surfaces.

In assembly, lip element 26 is urged toward wall 30 such that the locating pins 64 are engaged in their corresponding bushings 56, 56'. Bolts 51 are then inserted through bolt bores 50, engaged in threaded bores 55, and tightened to a torque value high enough to hold element 26 snugly against wall 30 but low enough to permit unconstrained X-direction enlargement or shrinkage of element 26, for example, a torque on each bolt of between about 35 inch-pounds and about 75 inch-pounds. Because of the short distances involved, differential thermal expansions in the Y and Z directions may be neglected. Within the scope of the invention, of course, studs may be substituted for bolts 51 and be inserted into bores 55, and element 26 may be secured conventionally by washers and nuts screwed onto the studs in outer portions 52.

Thus a replaceable hopper lip element may be fully constrained against a hopper bar in both the Y and Z directions and fully unconstrained in the X direction. Of course, within the scope of the invention, the locations of the precision locating pins and precision bushings may be exchanged without affecting the utility of the invention, that is, the pins may be disposed in the lip element and the bushings disposed in the hopper bar.

Thus the replaceable hopper lip system 70 includes the combination of means for removably attaching the lip element 72 which comprises a first elongated horseshoe magnet 76, 78, 80 disposed within the hopper 70 and a second elongated horseshoe magnet 76, 78, 80 disposed within the lip element 72 and either at least one locating pin 64 and at least one bushing 56 for receiving the pin 64 (shown in FIG. 3). The at least one locating pin 64 and at least one bushing 56 comprises means for invariantly locating a first portion of the lip element with respect to a first portion of the wall 30 and means for locating of the lip element 72 with respect to a second portion of the wall 30.

Figure 6:
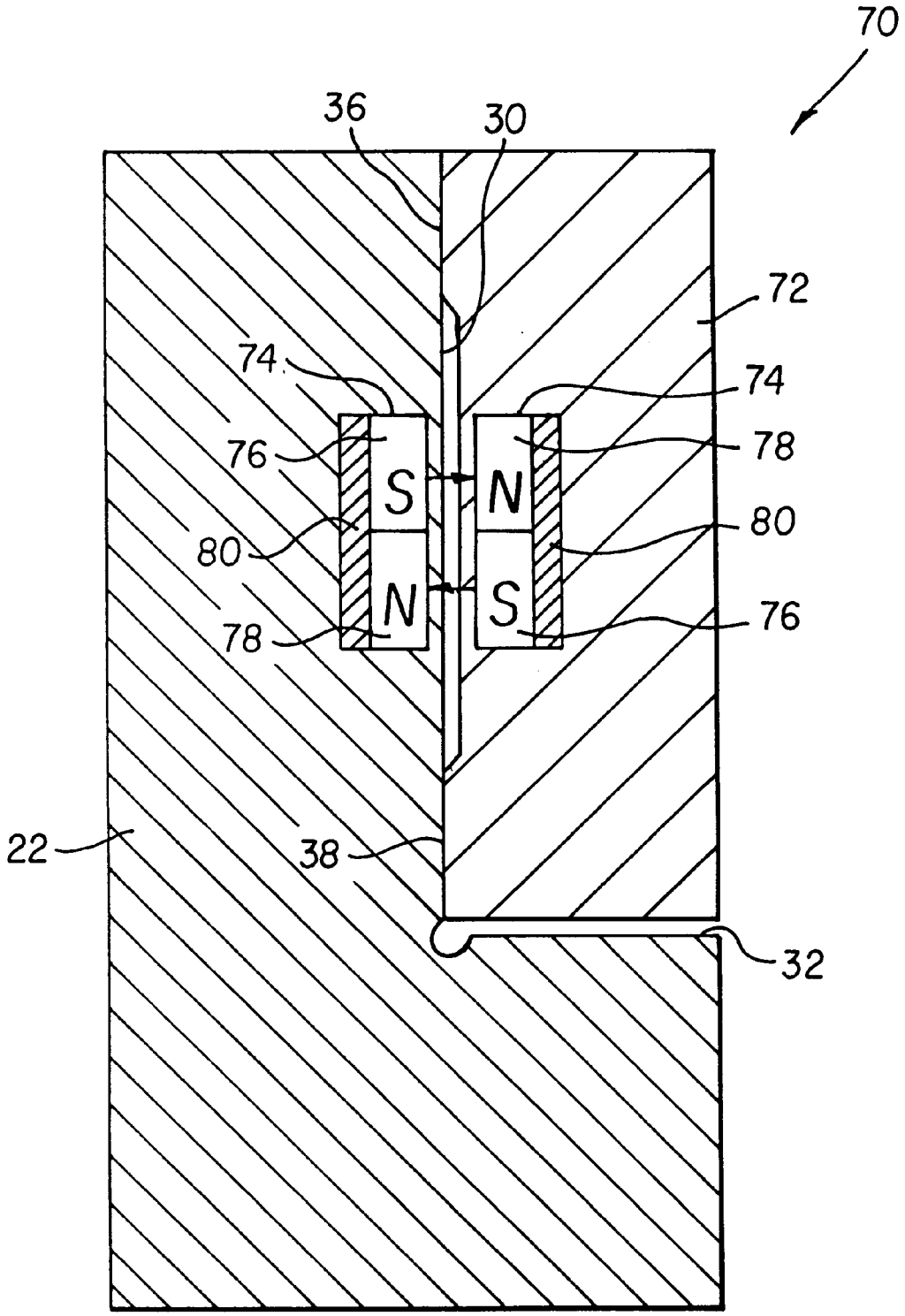
FIG. 6 is a vertical cross-sectional view through an alternative embodiment of a replaceable hopper lip element, showing the element attached to the hopper by linear magnets.
Figure 7:
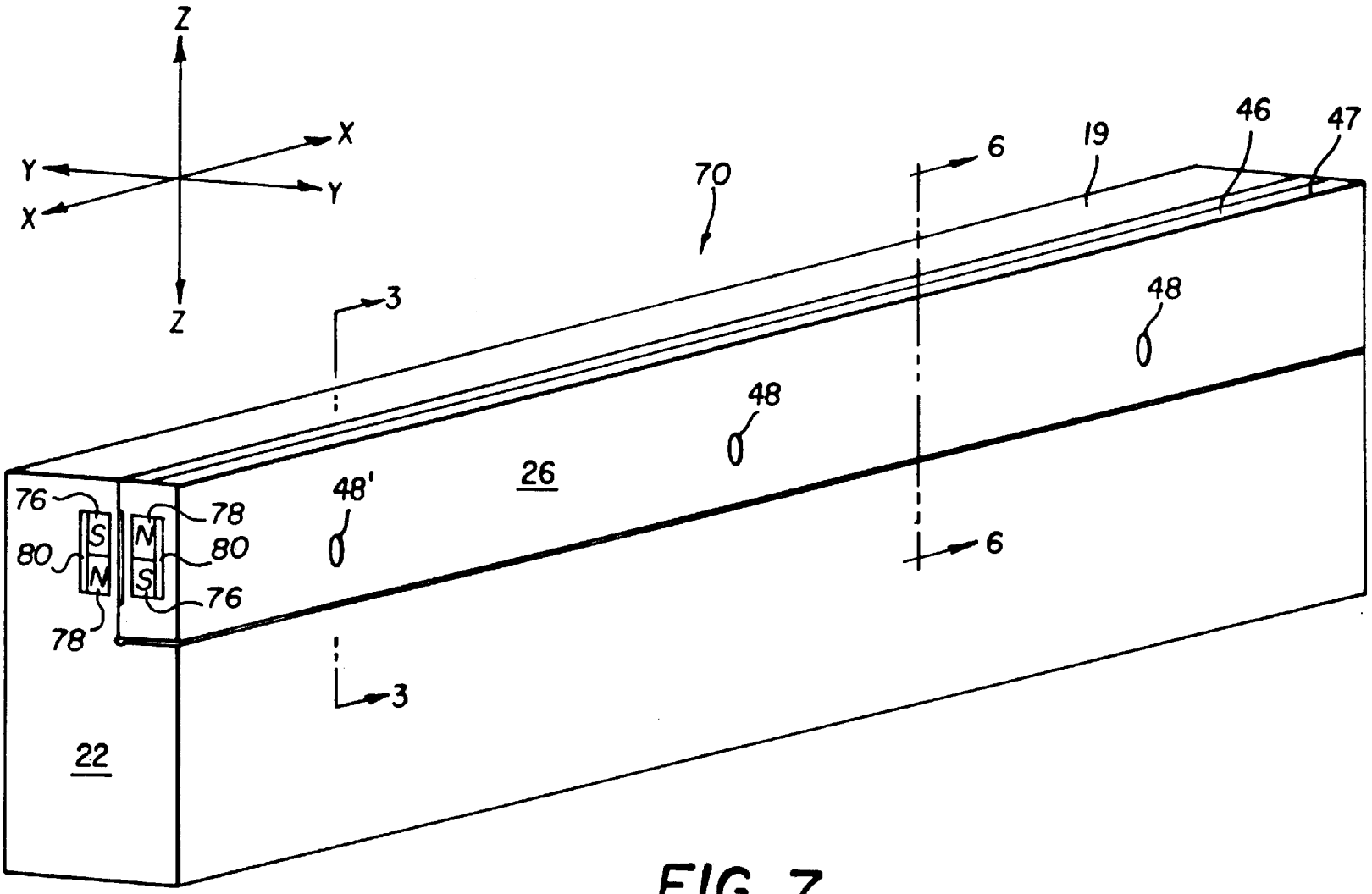
FIG. 7 is an isometric view of a front hopper bar having a hopper lip element in accordance with the second preferred embodiment of the invention.

In an alternative preferred embodiment 70, the bolting arrangement described in embodiment 45 is omitted and a magnetic attachment arrangement is substituted, as shown in FIGS. 3, 6 and 7. As previously described, a channel having walls 30,32 is formed in bar 22, and a lip element 72 like element 26 is provided with lands 36,38 for contact with wall 30. In a preferred method of fabrication, hopper bar 22 and lip element 72 are each provided with a rectangular passage 74 preferably extending the full longitudinal length of the bar and element. Into each passage 74 is inserted a pair of permanent linear magnets 76,78 oriented to have opposite polarity and an iron strip 80 for conducting magnetic flux therebetween and preventing formation of an external magnetic field, the assembly forming thereby a longitudinal horseshoe magnet. Magnets may be formed of iron or anisotropic magnetizable material, including ferroceramics, strontium ferrite, neodymiun/iron/boron (NdFeB), and other high energy rare earth magnetic materials. Preferably, the magnetic material has residual induction of between about 11.7 and about 12.0 kiloGauss, a coercive force of between about 10.5 and about 10.7 kiloOersteds, and a maximum energy of between about 33 and about 35 megaOersteds. The north magnet in the lip element is disposed opposite the south magnet in the hopper bar, and the south magnet in the lip element is disposed opposite the north magnet in the hopper bar, as shown in FIG. 6. Preferably, passages 74 are formed such that the spacing of the bar magnets from the lip magnets is less than about 0.060 inches. Such an arrangement can hold the lip element snugly against the hopper bar while still permitting relative X direction motion between the bar and lip element. The alternate preferred embodiment is used in conjunction with the locating bushings 56, 56' and pins 64 as described in the first preferred embodiment with reference to FIG. 3.

Alternatively, passages 74 may be formed as channels in each of bar 22 and lip element 72 and the magnets inserted into the channels from the surface, then retained in place by any suitable means such as being potted with epoxy.

In some applications, the only alignment means required between the hopper bar and the lip element 72 may be a single pin 64 and master bushing 56' as described above. In more demanding applications, it may be desirable to include one or more pins and bushings of the arrangement shown in embodiment 45.

The many features and advantages of the invention are apparent from the detailed specification and thus it is intended by the appended claims to cover all such features and advantages which fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

Parts List

10 bead coating apparatus
12 coating backing roller
14 web substrate
16 extrusion/slide hopper
18 layer of liquid composition
19 slide surface of 16
20 hopper body
22 front hopper bar
24 distribution cavity
26 replaceable hopper lip element
30 front wall of channel
32 bottom of channel
34 internal corner of channel
36 upperland
38 lower land
40 contact surface of 36
42 contact surface of 38
44 front face of 26
45 first preferred embodiment
46 slide surface of 26
47 coating lip means
48 bushing bores in 26
48' master bushing bore
50 bolt bores in 26
51 bolts
52 counterbore in 50
54 inner portion in 50
55 threaded bores in 22
56 precision bushing
56' master precision bushing
58 pin bores in 22
59 corner of 22
60 shoulder in 58
61 corner of 26
62 lower extremity in 58
64 pin in 58
66 cylindrical bore in 56'
68 slotted bores in 56
70 second preferred embodiment
72 lip element in 70
74 passage
76 first linear magnet
78 second linear magnet
80 iron strip

What is claimed is:

1. A coating hopper apparatus for coating a moving substrate, comprising:

a) a hopper lip element;

b) a front hopper bar which with a hopper body defines a distribution cavity for containing a coating which is applied onto the moving substrate and having a channel for removably receiving said lip element, said channel having a wall;

c) means for removably attaching said lip element to said wall;

d) means for invariantly locating and locking a first portion of said lip element with respect to a first portion of said wall, said lip element having an invariance in first, second, and third dimensions; and e) means for locating a second portion of said lip element with respect to a second portion of said wall, said locating being invariant in said first and second dimensions and variant in said third dimension.

2. The system of claim 1 wherein said lip element is from 0.25 to 4.00 inches.

3. The system of claim 1 wherein the lip on said lip element is from 0.001 to 0.250 inches.

4. A system in accordance with claim 1 wherein said means for invariantly locating comprises at least one locating pin and at least one bushing for receiving said locating pin, said pin being disposed in a bore in one of said first portion of said wall and said first portion of said lip element and said bushing being disposed in a bore in the other of said first portion of said wall and said first portion of said lip element.

5. A system in accordance with claim 4 wherein said locating pin is cylindrical and said bushing has a cylindrical bore for receiving said locating pin.

6. A system in accordance with claim 4 wherein said locating pin and said bushing are formed of a hard, dimensionally-stable, non-galling, corrosion-resistant material.

7. A system in accordance with claim 6 wherein the material forming said locating pin is selected from the group consisting of Stellite alloy, hardened and precipitation hardened stainless steels, tool steels, ceramics, cemented carbides, and materials having hard plated or coated surfaces.

8. A system in accordance with claim 1 wherein said means for locating a second portion comprises at least one locating pin and at least one bushing for receiving said pin, said pin being disposed in one of said second portion of said wall and said second portion of said lip element and said bushing being disposed in the other of said second portion of said wall and said second portion of said lip element, said locating pin being cylindrical and said bushing having a slotted bore for receiving said pin.

9. A system in accordance with claim 8 wherein the diameter of said slotted bore in one of said first and second dimensions is substantially equivalent to the diameter of said pin and wherein the width of said slotted bore in said third dimension is greater than said diameter of said pin.

10. A system in accordance with claim 8 comprising a plurality of said pins and said bushings having slotted bores.

11. A system in accordance with claim 1 wherein said hopper lip element comprises a longitudinal bar having a polygonal cross-section and having a hopper coating lip formed along a longitudinal corner thereof and having a pair of parallel lands formed on a surface thereof for making contact with said channel wall.

12. A system in accordance with claim 11 wherein said hopper lip element is formed from a material selected from the group consisting of metal, metal alloy, plastic polymer, glass, and ceramic.

13. A system in accordance with claim 1 wherein said means for removably attaching said lip element comprises:

a) at least one threaded bore formed in said channel wall;

b) a threaded fastener disposed in said threaded bore, said fastener being selected from the group consisting of a bolt and a stud.

14. A system in accordance with claim 1 wherein said means for removably attaching said lip element comprises:

a) a first elongated horseshoe magnet disposed within said hopper; and b) a second elongated horseshoe magnet disposed within said lip element.

15. A system in accordance with claim 14 wherein each of said first and second horseshoe magnets includes a pair of parallel longitudinal magnets disposed in opposing polarity and an iron strip coupling said pair of magnets.

16. A system in accordance with claim 14 wherein at least one of said first and second horseshoe magnets comprises a magnetic material selected from the group including iron, anisotropic magnetizable material, ferroceramics, strontium ferrite, neodymiun/iron/boron (NdFeB), and any other high energy rare earth magnetic materials.

17. A system in accordance with claim 14 wherein at least one of said magnets is formed from a magnetic material having a residual induction of between about 11.7 and about 12.0 kiloGauss, a coercive force of between about 10.5 and about 10.7 kiloOersteds, and a maximum energy of between about 33 and about 35 megaOersteds.

18. A coating hopper apparatus for coating a moving substrate, comprising:

a) a hopper lip element;

b) a front hopper bar which with a hopper body defines a distribution cavity for containing a coating which is applied onto the moving substrate having a channel for removably receiving said lip element, said channel having a wall;

c) means for removably attaching said lip element to said wall including a first elongated horseshoe magnet disposed within said hopper and a second elongated horseshoe magnet disposed within said lip element.

19. A system in accordance with claim 18 further comprising at least one locating pin and at least one bushing for receiving said pin, said pin being disposed in a bore in one of said first portion of said wall and said first portion of said lip element and said bushing being disposed in a bore in the other of said first portion of said wall and said first portion of said lip element.

* * * * *